US008734121B2

(12) United States Patent
Tsen

(10) Patent No.: US 8,734,121 B2
(45) Date of Patent: May 27, 2014

(54) FLOW GUIDE STRUCTURE FOR BLADELESS AIR FANS

(75) Inventor: Samson Tsen, Taipei (TW)

(73) Assignee: Kable Enterprise Co., Ltd., Taipei (TW)

( * ) Notice: Subject to any disclaimer, the term of this patent is extended or adjusted under 35 U.S.C. 154(b) by 163 days.

(21) Appl. No.: 13/221,732

(22) Filed: Aug. 30, 2011

(65) Prior Publication Data

US 2012/0318393 A1 Dec. 20, 2012

(30) Foreign Application Priority Data

Jun. 16, 2011 (TW) ..... 100210919 U

(51) Int. Cl.
*F04B 23/14* (2006.01)
*F04F 5/46* (2006.01)
*B05B 1/26* (2006.01)

(52) U.S. Cl.
USPC ..... 417/76; 417/198; 239/506

(58) Field of Classification Search
USPC ..... 239/504, 506, 518, 592, 593, 594, 595, 239/596, 597, 598, 599, 601; 417/76, 155, 417/177, 198, 382, 390
See application file for complete search history.

(56) References Cited

U.S. PATENT DOCUMENTS

| | | | | | |
|---|---|---|---|---|---|
| 2,488,467 | A * | 11/1949 | De Lisio Salvatore | ..... | 239/561 |
| 5,762,034 | A * | 6/1998 | Foss | ..... | 123/41.49 |
| 2009/0060710 | A1 * | 3/2009 | Gammack et al. | ..... | 415/90 |

FOREIGN PATENT DOCUMENTS

| | | | | |
|---|---|---|---|---|
| JP | S64-21300 | * 2/1992 | ..... | F04F 5/16 |
| TW | M394383 | * 11/2010 | ..... | F04D 25/02 |
| TW | M394383 | 12/2010 | | |
| TW | M398032 | 2/2011 | | |

* cited by examiner

*Primary Examiner* — Bryan Lettman
(74) *Attorney, Agent, or Firm* — Muncy, Geissler, Olds & Lowe, P.C.

(57) ABSTRACT

A flow guide structure for a bladeless air fan. The bladeless air fan includes a host and an airflow guiding frame. The host includes an airflow generator. The airflow guiding frame is connected to the host and includes an air discharging portion which has an airflow guiding passage inside to communicate with the airflow generator. The air discharging portion also includes an airflow gathering wall, an inner ring compression wall and an outer ring compression wall extended forwards from two ends of the airflow gathering wall. From the junctions of the airflow gathering wall and inner ring compression wall and outer ring compression wall, the inner ring compression wall and outer ring compression wall are spaced from each other at a decreasing interval between them, and the inner ring compression wall and outer ring compression wall also have distal ends forming a front air outlet to discharge airflow forwards.

15 Claims, 6 Drawing Sheets

FLOW GUIDE STRUCTURE FOR BLADELESS AIR FANS

FIELD OF THE INVENTION

The present invention relates to a flow guide structure for bladeless air fans and particularly to an air fan that has an airflow generator hidden inside and an airflow guiding frame to facilitate discharge of airflow.

BACKGROUND OF THE INVENTION

An air fan relies on spinning blades to pressurize air to generate airflow. A conventional air fan has exposed blades driven by a motor to get spinning and a mesh type frame to surround the blades to avoid hurting people. But the frame still has gaps and small children could poke fingers inadvertently through the gaps of the frame and be injured by the high speed spinning blades. The frame also cannot prevent small articles from piercing through, hence small children could also insert incidentally playing articles into the frame to damage the articles or the blades. Moreover, the frame cannot prevent dust from accumulating on the blades. Unless the fan is washed and cleaned frequently the spinning blades could throw a great amount of dust outside to cause allergic implications on respiratory organs and skin of people after a prolonged period of time, or even inflict ailments.

Hence improvements of air fan have been constantly made. Now bladeless air fans with hidden blades have been developed and introduced on the market. For instance, R.O.C. patent M398032 entitled "Bladeless air fan" includes a base and a holder fastened to the base to house a motor, and a set of blades hinged on the motor. The holder has a latch portion on the top connecting to an air discharge portion which is a circular frame and has a slit air outlet behind the inner rim. The motor drives the blades spinning. Airflow generated by the blades blows upwards and is discharged through an annular air outlet at the air discharge portion. The blades are hidden in the holder without the risk of injuring children during spinning, and dust accumulating on the blades also can be reduced, and spreading of the dust can also be further reduced through the air discharge portion. However, its air outlet is located at the inner rear side of the air discharge portion and formed in a tortuous manner, airflow resistance passing through the air outlet increases and results in decrease of airflow power. As a result, the airflow power generated by the bladeless air fan is significantly smaller than the general air fan. The bladeless air fan is more expensive but does not provide desirable performance, hence is not well accepted on the market.

R.O.C. patent M394383 entitled "Bladeless air fan" provides another type of bladeless air fan that includes a frame and an airflow guiding means. The frame has an airflow passage and at least one airflow orifice set. The airflow guiding means is connected to the frame and has a hollow airflow guiding frame and an airflow guiding set. The airflow guiding frame has an airflow guiding passage communicating with the airflow passage. The airflow guiding set is located at a selected position in the airflow guiding passage to direct airflow direction and airflow speed of the air in the airflow guiding passage. Its airflow passage further is divided into an air intake passage and an air discharge passage. It also has a number of air inlets and air outlets formed alternately and annularly on the inner rim of the frame. It also has the drawback of inadequate airflow amount like the previous reference. In the reference of M398032 the annular air outlet surrounding the entire air discharge portion still cannot provide a greater amount of airflow. In the reference of M394383, with the air inlets and outlets located on the inner rim of the frame, the problem of inadequate airflow power also is unavoidable.

U.S. Pub No. 2009/0060710 discloses another type of air fan to provide improved airflow discharge. It is a bladeless air fan including a nozzle, a device for creating an airflow through the nozzle and a mouth to channel the airflow in the nozzle. The mouth is located behind the inner rim of the nozzle. The mouth has a Coanda surface on the circumference. Through the Coanda effect of fluid kinetics the airflow tends to adhere to the Coanda surface and change the flow direction so that the airflow shifts to exit via the mouth at the rear side of the inner rim. While it has the advantage of balanced airflow because of the Coanda effect, the shifted airflow also generates resistance to the airflow and results in lower airflow exit speed.

In short, the aforesaid conventional techniques still have disadvantages, notably:

1. Inadequate airflow speed or amount, besides being inferior in performance than the conventional air fan, they also create environmental problem because of lower electric power efficiency.

2. Due to the air outlets are mostly located at the rear side of the frame to discharge airflow forwards the airflow generation means (including motor) is usually located below the frame. As a result, airflow discharged forwards generates air turbulence in front of the frame. This not only further reduces airflow discharge speed, spatial allocation and utilization of the frame also are less desirable.

3. Due to the airflow generation means is located below the frame, swivel direction of the frame is restricted.

Thus the conventional bladeless air fans have a common problem, i.e. with a given motor power output, the generated airflow power is notably less than the conventional air fans. Design of airflow guide also restricts swivel and positioning of the frame.

SUMMARY OF THE INVENTION

In view of the conventional bladeless air fans not able to provide adequate airflow speed or amount, the primary object of the present invention is to provide an improved bladeless air fan with an improved design of airflow guiding passage and air outlet to reduce airflow resistance and increase airflow speed and amount.

The present invention provides a flow guide structure for bladeless air fans. The bladeless air fan includes a host and an airflow guiding frame. The host includes an airflow generator. The airflow guiding frame is connected to the host and includes an air discharging portion which forms an airflow guiding passage inside to communicate with the airflow generator and also including a closed airflow gathering wall, and an inner ring compression wall and an outer ring compression wall extended forwards from two ends of the airflow gathering wall. From the junctions of the airflow gathering wall and inner ring compression wall and outer ring compression wall, the inner ring compression wall and outer ring compression wall are spaced from each other at a gradually shrinking distance between them, and the inner ring compression wall and outer ring compression wall also respectively contain distal ends spaced from each other by a gap to form a front air outlet to discharge airflow forwards.

By means of the features set forth above, the gradually shrinking gap is formed at the front air outlet between the inner ring compression wall and outer ring compression wall so that the interior of the airflow gathering wall has more space to allow airflow provided by the airflow generator to rapidly enter the air discharging portion. The shrinking inner ring compression wall and outer ring compression wall with respect to each other can accelerate the flow speed of the airflow. The air finally is blown out through the air outlet at the front end of the inner ring compression wall and outer ring compression wall. The structure thus formed provides many benefits, notably:

1. Airflow in the airflow guiding frame does not turn in a great angle, thus producing smaller airflow resistance, and airflow discharging speed is faster.

2. Due to the smaller airflow resistance, in a given power of the airflow generator, a greater amount of airflow can be generated than the conventional techniques.

3. With increased airflow speed and amount, less electric power is consumed for a given performance requirement. Hence this invention also has the advantages of environmental-friendly and energy-saving.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
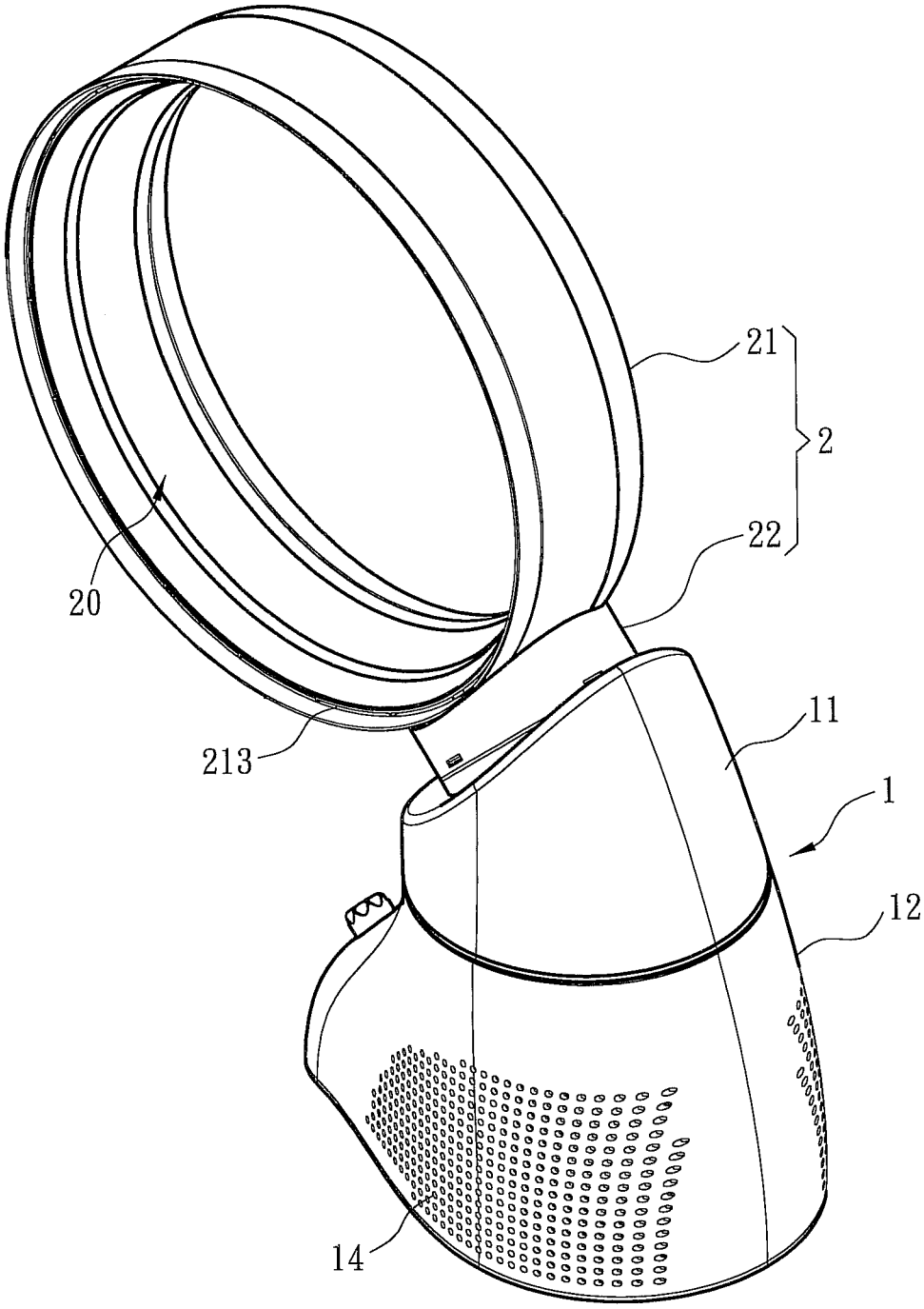
FIG. 1 is a perspective view of the bladeless air fan of the invention.
Figure 2:
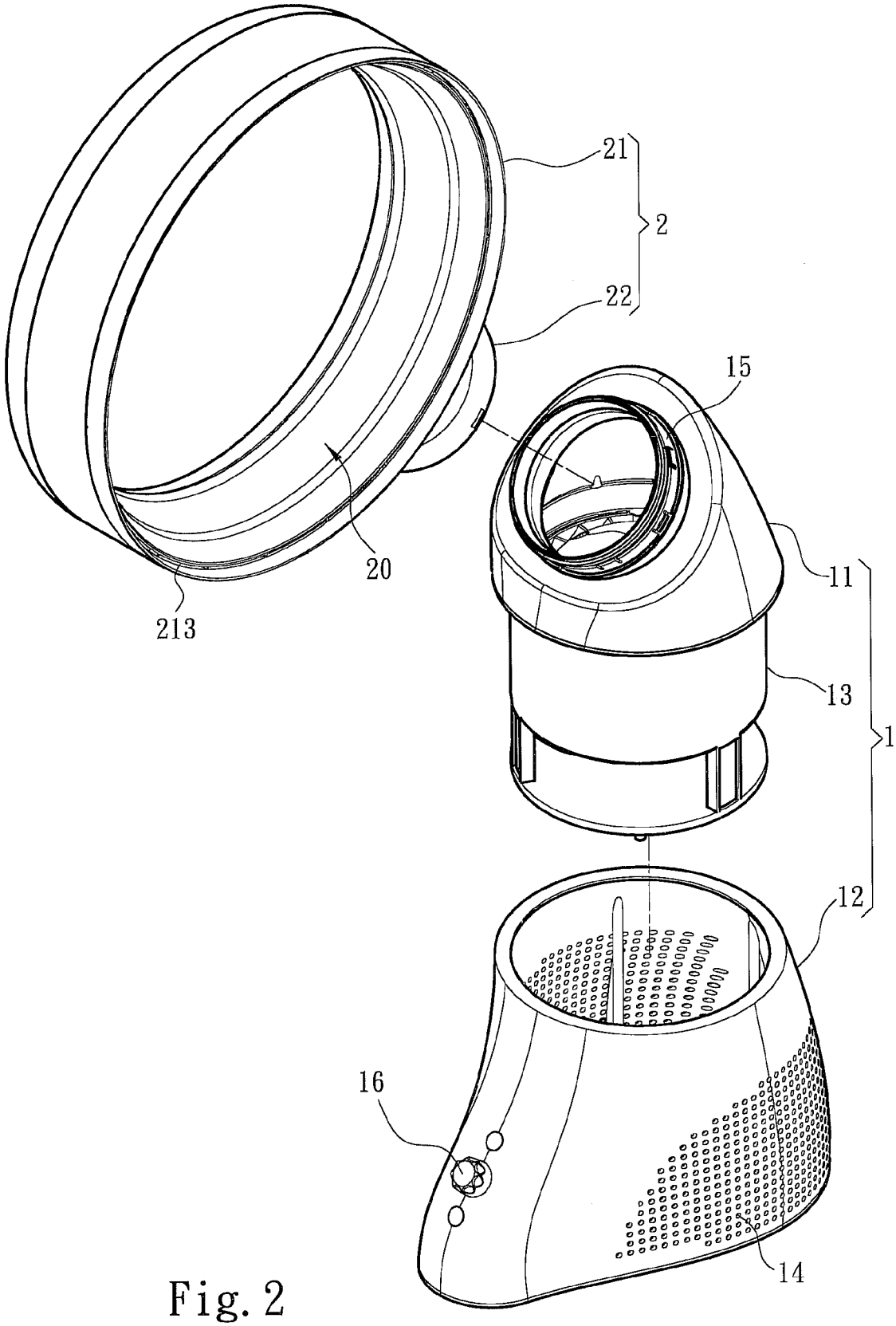
FIG. 2 is an exploded view of the bladeless air fan of the invention.

Please referring to FIGS. 1 and 2, the present invention aims to provide a flow guide structure for a bladeless air fan. The bladeless air fan includes a host 1 and an airflow guiding frame 2 connecting to the host 1. FIGS. 1 and 2 show an embodiment in which the host 1 includes an upper case 11, a lower case 12 and an airflow generator 13 held in the upper and lower cases 11 and 12. The embodiment shown in FIGS. 1 and 2 is merely for illustrative purpose and not the limitation of the invention in terms of the components of the host 1 or case structure. Modifications of the cases and other profiles can be made easily by those skilled in the art and shall be included in the scope of this invention. The lower case 12 has a control portion 16 and a plurality of air inlets 14 to supply air to the airflow generator 13. The control portion 16 provides electric signals to control the airflow generator 13. The control portion 16 is electrically connected to the airflow generator 13. Its connection method and operation principle also are known in the art, thus details are omitted herein. The host 1 and airflow guiding frame 2 can be selectively coupled in a fixed manner, or the airflow guiding frame 2 can be rotated relative to the host 1 for a selective angle as a preferable embodiment. The upper case 11 in the embodiment shown in FIGS. 1 and 2 has a first pivotal coupling portion 15 which is a hollow tubular member to communicate with the airflow generator 13 to allow airflow generated by the airflow generator 13 passing through. The airflow guiding frame 2 includes an air discharging portion 21 and a second pivotal coupling portion 22 which also is a hollow tubular member to communicate with the air discharging portion 21. The second pivotal coupling portion 22 and air discharging portion 21 form an airflow guiding passage 215 inside (also referring to FIG. 4). The second pivotal coupling portion 22 is pivotally coupled with the first pivotal coupling portion 15 in a rotatory manner, and also communicates therewith so that the airflow generated by the airflow generator 13 passes through the first and second pivotal coupling portions 15 and 22 to reach the airflow guiding passage 215 (also referring to FIG. 4). The first and second pivotal coupling portions 15 and 22 include a plurality of annular flanges and grooves to latch each other for retaining so that the first and second pivotal coupling portions 15 and 22 can be coupled and rotated relatively to each other. The aforesaid pivotal coupling structure of the first and second pivotal coupling portions 15 and 22 are known to those in the art, alterations thereof shall be included in the scope of the invention.

Figure 3A:
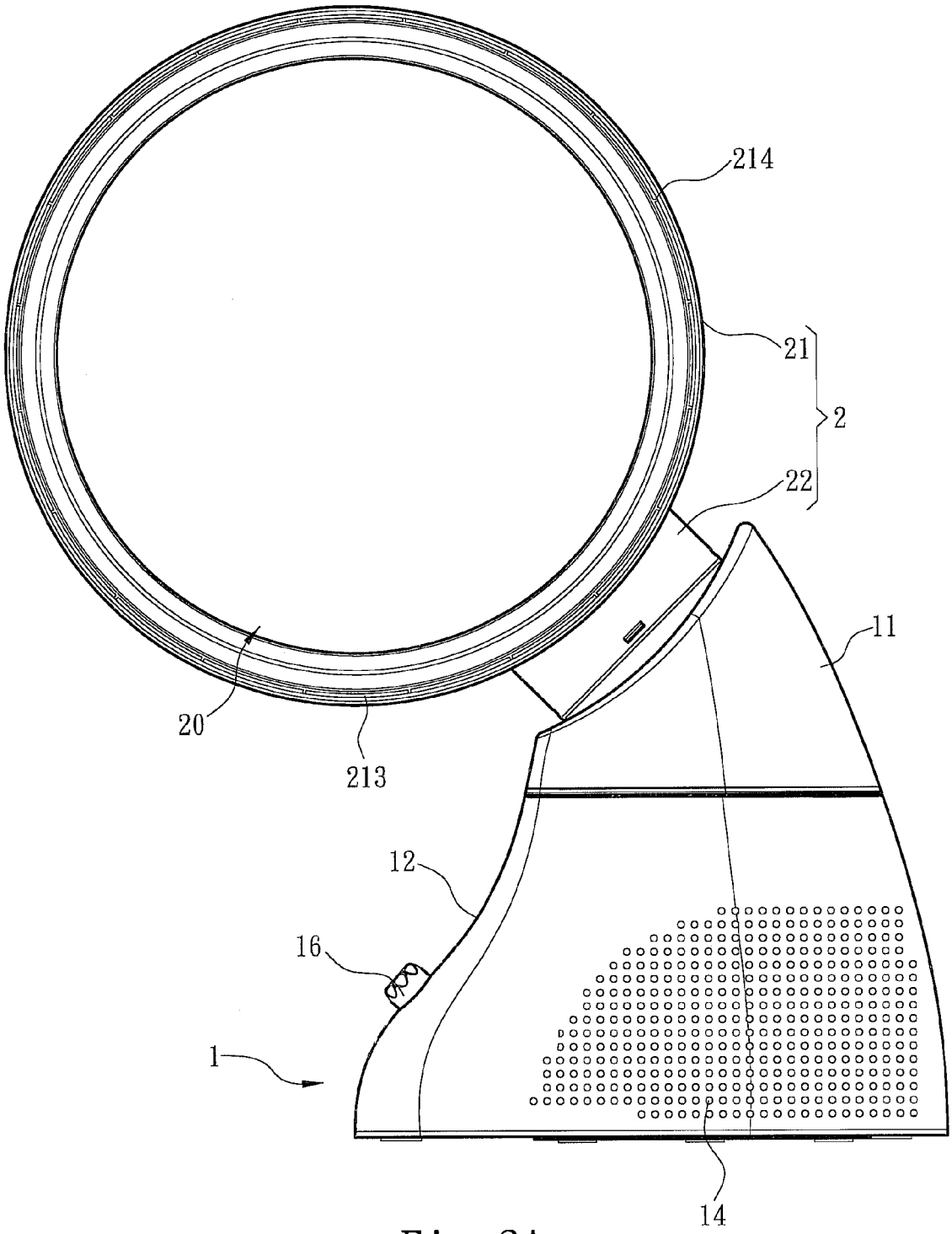
FIG. 3A is a schematic view of the bladeless air fan of the invention showing the airflow discharging portion rotating to a specific angle.
Figure 3B:
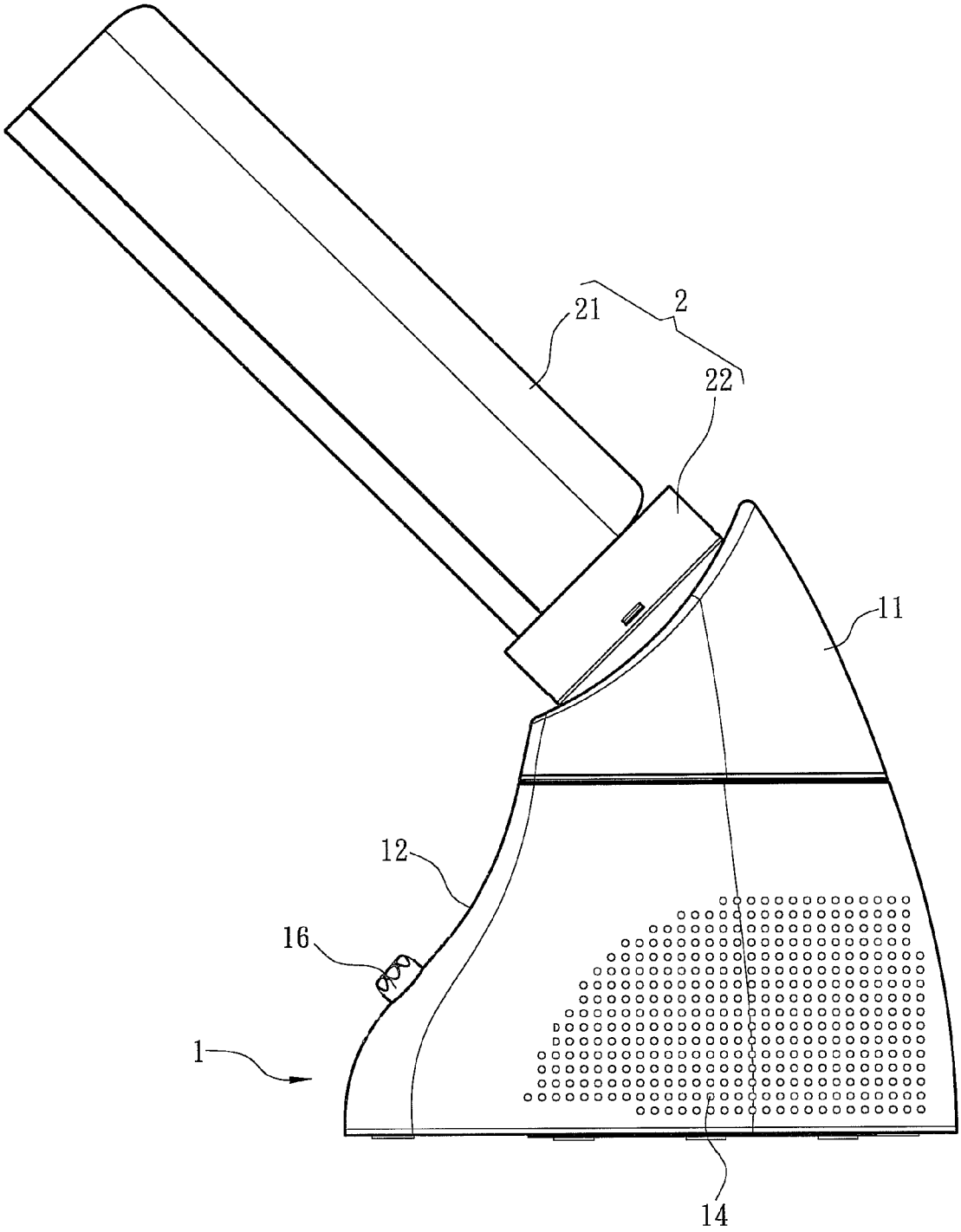
FIG. 3B is a schematic view of the bladeless air fan of the invention showing the airflow discharging portion rotating to another specific angle.

The air discharging portion 21 shown in FIGS. 1 and 2 is annular and encircles an airflow passage 20 to allow air passing through axially. The air discharging portion 21 also has a front air outlet 213 at the front end thereof. When the front air outlet 213 blows airflow forwards, air pressure fluctuations take place to drive the air in the airflow passage 20 to flow in the direction of the blown airflow. Thus an axial airflow passing through the airflow passage 20 is formed to supply airflow as desired. Since the air discharging portion 21 is fully annular, airflow passing through the airflow passage 20 is more uniform and converged. Also referring to FIGS. 3A and 3B, through the first and second pivotal coupling portions 15 and 22 rotating relatively to each other, the airflow discharge direction of the air discharging portion 21 can also be changed along with the airflow discharge direction. As the host 1 is located beneath the airflow discharging portion 21 which is pivotally coupled with the first pivotal coupling portion 15 extended from the host 1, the airflow generated by the airflow generator 13 is directed through the first pivotal coupling portion 15 to enter the airflow guiding passage 215. Hence the rotation of the air discharging portion 21 does not affect the airflow direction entering the airflow guiding passage 215 discharged from the airflow generator 13, so that the air discharging portion 21 can rotate 360 degrees without affecting the airflow entering the airflow guiding passage 215. Therefore, the airflow discharging portion 21 can rotate from a specific angle, shown in FIG. 3A, to another specific angle, shown in FIG. 3B. Hence multi-directional airflow discharge can be accomplished. The front air outlet 213 can also be selectively divided by at least one spacer 214 (referring to FIG. 3A).

Figure 4:
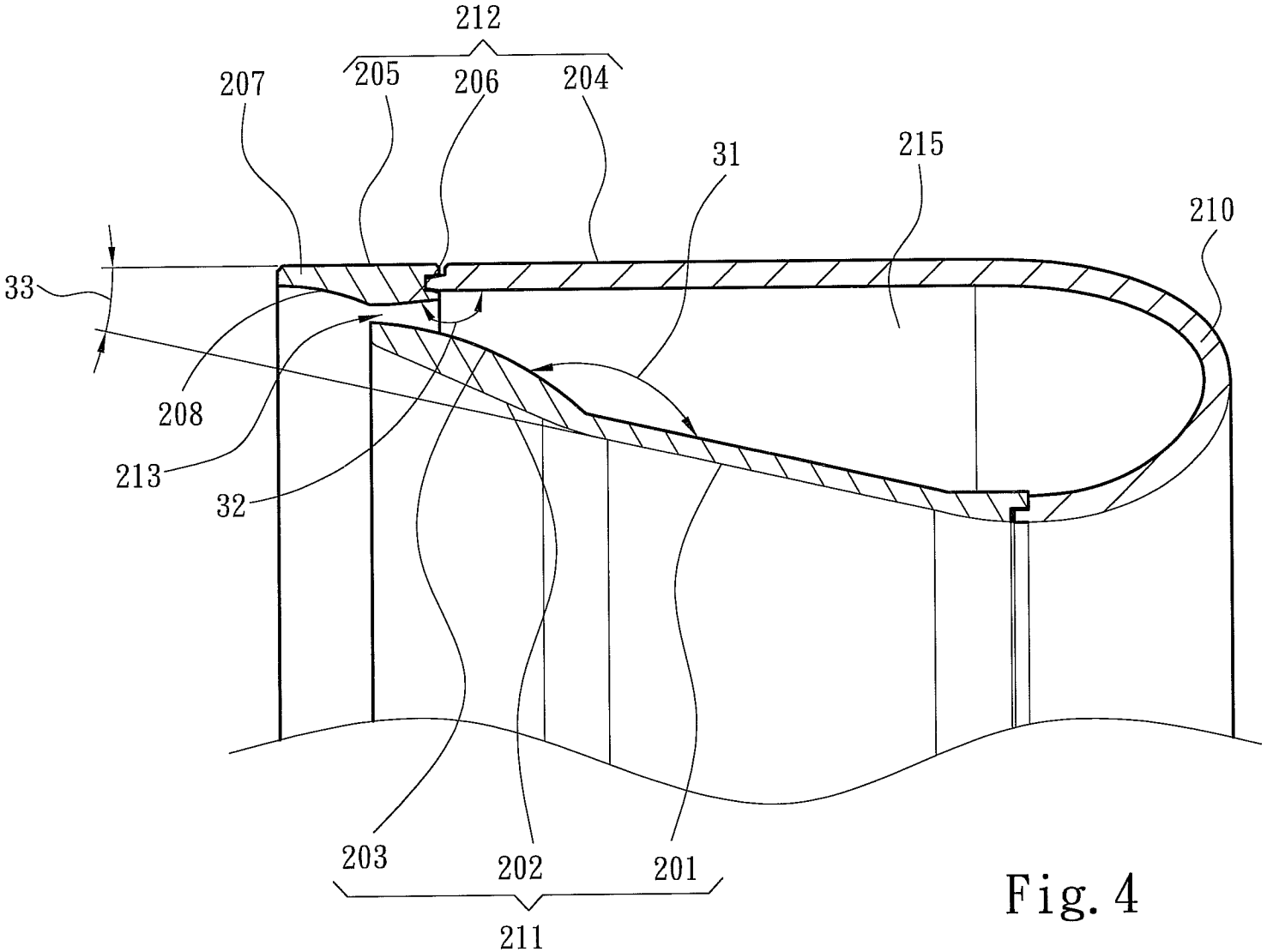
FIG. 4 is a fragmental enlarged view of the bladeless air fan of the invention.
Figure 5:
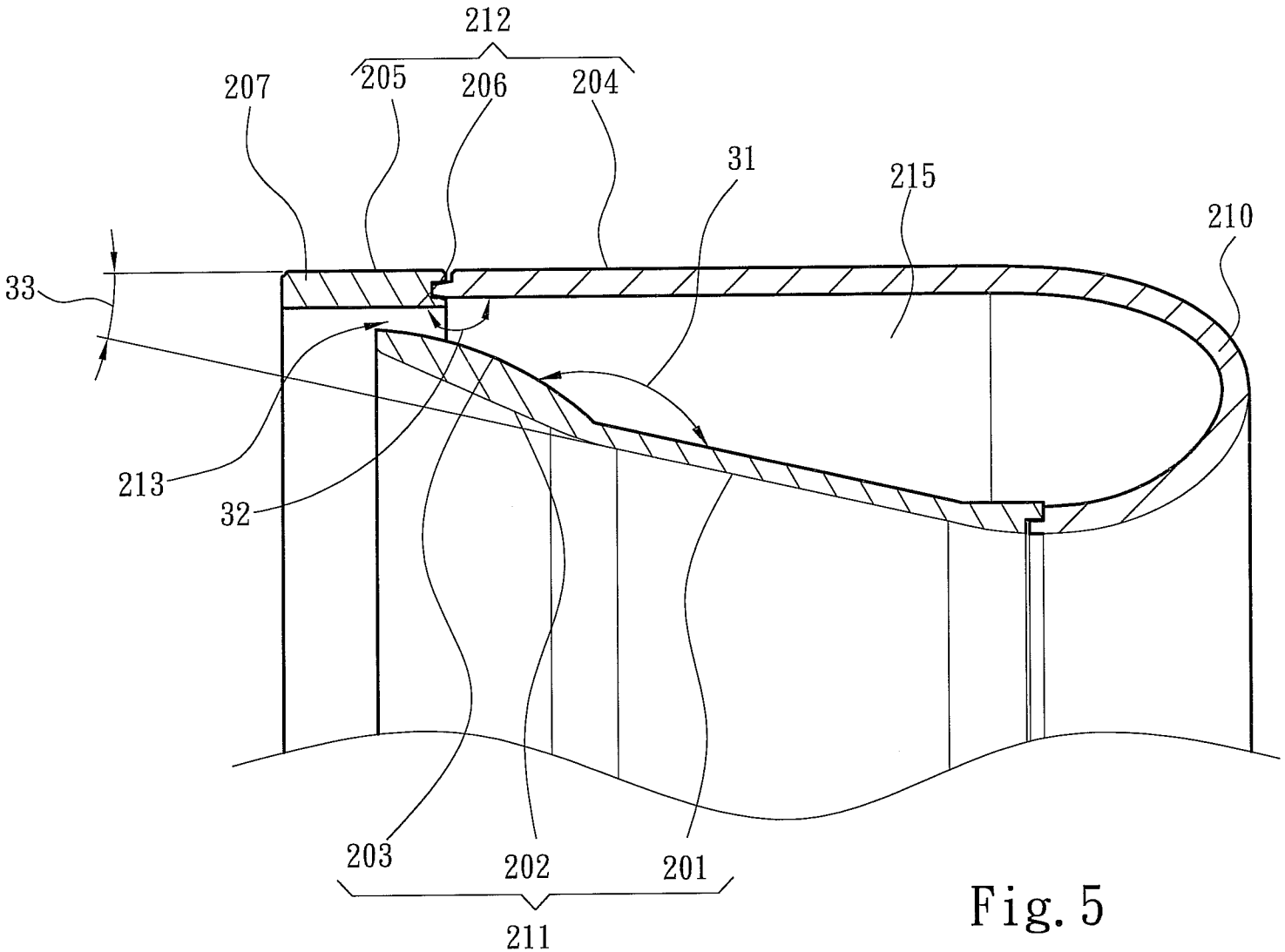
FIG. 5 is another fragmental enlarged view of the bladeless air fan of the invention.

Refer to FIG. 4 for the detailed structure of the air discharging portion 21. It includes an airflow gathering wall 210, an inner ring compression wall 211 and an outer ring compression wall 212. The inner ring compression wall 211 and outer ring compression wall 212 have respectively a distal end spaced from each other by a gap to form the front air outlet 213. The airflow gathering wall 210 is bent in a U shape and formed a greater space inside to allow airflow generated by the airflow generator 3 to rapidly enter the air discharging portion 21. The airflow gathering wall 210 has two ends extended respectively forwards to form the inner ring compression wall 211 and outer ring compression wall 212. From the junctions of the airflow gathering wall 210 and the inner ring compression wall 211 and outer ring compression wall 212, the inner ring compression wall 211 and outer ring compression wall 212 are spaced from each other at a gradually shrinking distance between them. The inner ring compression wall 211 further has a first extension 201 and a first compression section 202 which has a first compression convex rim 203 on the inner side extended from the junction of the first extension 201 and first compression section 202 to the front air outlet 213. The first compression convex rim 203 can be selectively a flat surface, or preferably an arched surface as shown in FIG. 4 to achieve desirable airflow guiding effect. The first compression convex rim 203 and first extension 201 form a first included angle 31 between 130 and 160 degrees, preferably 145 degrees. Similarly, the outer ring compression wall 212 further has a second extension 204 and a second compression section 205 which has a second compression convex rim 206 on the inner side with the surface extended to the front air outlet 213. The second compression convex rim 206 and second extension 204 also form a second included angle 32 between 140 and 175 degrees, preferably 175 degrees. More specifically, the outer ring compression wall 212 is extended flatly from the airflow gathering wall 210, and the inner ring compression wall 211 is inclined towards the outer ring compression wall 212 at an angle so that a third included angle 33 is formed between the inner ring compression wall 211 and outer ring compression wall 212. The third included angle 33 is between 10 and 15 degrees, preferably 11 degrees. The second compression section 205 further extends a guiding section 207 beyond the front air outlet 213 that has a guiding surface 208 to direct airflow discharged from the front air outlet 213 so that a portion of the airflow can be guided by the guiding surface 208 to form a converged airflow blowing forwards without spreading outwards. FIG. 4 illustrates an embodiment of the guiding surface 208 in a curved surface, while FIG. 5 shows the second compression convex rim 206 being flatly extended to the guiding section 207 with a portion of surface of the second compression convex rim 206 served as an inner surface of the guiding section 207.

By means of the features set forth above, the inner ring compression wall 211 and outer ring compressing wall 212 form a shrinking gap between them towards the front air outlet 213 so that a greater space is provided inside the airflow gathering wall 210 to allow the airflow generated by the airflow generator 13 to rapidly enter the air discharging portion 21. The shrinking interval between the inner ring compression wall 211 and outer ring compressing wall 212 also accelerates airflow speed. Moreover, according fluid dynamics, the first included angle 31 between the first compression convex rim 203 and first extension 201 can produce a first stage compression on the airflow passing through, and the second included angle 32 between the second compression convex rim 206 and second extension 204 can produce a second stage compression on the airflow passing through. After this two-stage compression, a high speed airflow at a greater volume is discharged through the front air outlet 213.

In addition, the front air outlet 213 is located at the front end of the air discharging portion 21, with the first pivotal coupling portion 15 pivotally coupled to the airflow guiding frame 2, the airflow guiding frame 2 can rotate about the first and second pivotal coupling portions 15 and 22 as axes against the host 2 at a greater angular range to provide a greater airflow discharge scope.

As a conclusion, the present invention provides many advantages, notably:

1. Airflow in the airflow guiding frame 2 does not turn at a great angle, hence airflow resistance is smaller, and airflow discharge speed is faster.

2. Due to smaller airflow resistance the airflow generator 13 of a given power can provide a greater amount of airflow.

3. With increased airflow speed and amount, electric power consumption is smaller for a given performance requirement, hence environmental-friendly and energy-saving effect can also be accomplished 4. Since the airflow guiding frame 2 can rotate relatively to the host 1 at a greater angular range, a greater range of airflow discharge can be provided.

While the invention has been described by means of specific embodiments, numerous modifications and variations could be made thereto by those skilled in the art without departing from the scope and spirit of the invention set forth in the claims.

In summation of the above description, the present invention provides a significant improvement over the conventional techniques and complies with the patent application requirements, and is submitted for review and granting of the commensurate patent rights.

What is claimed is:

1. A flow guide structure for bladeless air fans, comprising:

a host including an airflow generator;

an airflow guiding frame which is connected to the host and includes an air discharging portion, the air discharging portion forming an airflow guiding passage inside to communicate with the airflow generator and including a closed airflow gathering wall, an inner ring compression wall and an outer ring compression wall extended forwards respectively from two ends of the airflow gathering wall, the inner ring compression wall and the outer ring compression wall being spaced from each other at a gradually shrinking distance respectively from a junction between the airflow gathering wall and the inner ring compression wall and the junction between the air gathering wall and the outer ring compression wall, the inner ring compression wall and the outer ring compression wall comprising respectively a distal end spaced from each other by a gap to form a front air outlet to discharge airflow forwards;

wherein the inner ring compression wall further includes a first extension and a first compression section which comprises a first compression convex rim on an inner side, the first compression convex rim comprising a surface extended to the front air outlet, wherein the outer ring compression wall further includes a second extension and a second compression section which comprises a second compression convex rim on an inner side, the second compression convex rim comprising a surface extended to the front air outlet.

2. The flow guide structure for bladeless air fans of claim 1, wherein the first compression convex rim and the first extension form a first included angle between 130 degrees and 160 degrees.

3. The flow guide structure for bladeless air fans of claim 2, wherein the first included angle between the first compression convex rim and the first extension is 145 degrees.

4. The flow guide structure for bladeless air fans of claim 1, wherein the inner ring compression wall and the outer ring compression wall form a third included angle ranged from 10 degrees to 15 degrees.

5. The flow guide structure for bladeless air fans of claim 1, wherein the host includes a first pivotal coupling portion communicating with the airflow generator, the airflow guiding frame including a second pivotal coupling portion communicating with the airflow guiding passage, the second pivotal coupling portion being coupled with the first pivotal coupling portion in a rotatory manner to communicate with the air generator and the airflow guiding passage.

6. The flow guide structure for bladeless air fans of claim 1, wherein the front air outlet includes at least one spacer.

7. A flow guide structure for bladeless air fans, comprising:

a host including an airflow generator;

an airflow guiding frame which is connected to the host and includes an air discharging portion, the air discharging portion forming an airflow guiding passage inside to communicate with the airflow generator and including a closed airflow gathering wall, an inner ring compression wall and an outer ring compression wall extended forwards respectively from two ends of the airflow gathering wall, the inner ring compression wall and the outer ring compression wall being spaced from each other at a gradually shrinking distance respectively from a junction between the airflow gathering wall and the inner ring compression wall and the junction between the air gathering wall and the outer ring compression wall, the inner ring compression wall and the outer ring compression wall comprising respectively a distal end spaced from each other by a gap to form a front air outlet to discharge airflow forwards;

wherein the outer ring compression wall further includes a second extension and a second compression section which comprises a second compression convex rim on an inner side, the second compression convex rim comprising a surface extended to the front air outlet.

8. The flow guide structure for bladeless air fans of claim 7, wherein the second compression convex rim and the second extension form a second included angle between 140 degrees and 175 degrees.

9. The flow guide structure for bladeless air fans of claim 8, wherein the second included angle between the second compression convex rim and the second extension is 175 degrees.

10. The flow guide structure for bladeless air fans of claim 7, wherein the second compression section further extends a guiding section which includes a guiding surface to direct the airflow discharged from the front air outlet.

11. The flow guide structure for bladeless air fans of claim 10, wherein the guiding surface is a flat surface.

12. The flow guide structure for bladeless air fans of claim 10, wherein the guiding surface is an arched surface.

13. The flow guide structure for bladeless air fans of claim 7, wherein the inner ring compression wall and the outer ring compression wall form a third included angle ranged from 10 degrees to 15 degrees.

14. The flow guide structure for bladeless air fans of claim 7, wherein the host includes a first pivotal coupling portion communicating with the airflow generator, the airflow guiding frame including a second pivotal coupling portion communicating with the airflow guiding passage, the second pivotal coupling portion being coupled with the first pivotal coupling portion in a rotatory manner to communicate with the air generator and the airflow guiding passage.

15. The flow guide structure for bladeless air fans of claim 7, wherein the front air outlet includes at least one spacer.

* * * * *